United States Patent [19]

Cloud

[11] 4,301,877

[45] Nov. 24, 1981

[54] CLAD MUD NOZZLE

[75] Inventor: John D. Cloud, Houston, Tex.

[73] Assignee: Hughes Tool Company, Houston, Tex.

[21] Appl. No.: 128,695

[22] Filed: Mar. 10, 1980

[51] Int. Cl.[3] ..... E21C 13/01

[52] U.S. Cl. ..... 175/340

[58] Field of Search ..... 175/340, 393; 299/81; 339/591, 601

[56] References Cited

U.S. PATENT DOCUMENTS

| | | | |
|---|---|---|---|
| 2,520,362 | 8/1950 | Goolsbee | 175/340 |
| 3,096,834 | 7/1963 | Steen | 175/340 |
| 3,111,179 | 11/1963 | Albers et al. | 175/393 |
| 3,129,777 | 4/1964 | Haspert | 175/340 |
| 3,131,779 | 5/1964 | Rowley et al. | 175/393 |
| 3,179,189 | 4/1965 | Goodwin | 175/340 |
| 3,207,241 | 9/1965 | Nellson | 175/340 |

*Primary Examiner*—James A. Leppink

*Attorney, Agent, or Firm*—Robert A. Felsman

[57] ABSTRACT

An earth boring drill bit has a drilling fluid nozzle with features that protect the nozzle retaining ring from erosion and avoid pressing cracks. The drill bit has a passage with at least one outlet and a nozzle located at the outlet for discharging fluid. The nozzle has a shell mounted in the outlet and retained by a retaining ring. An insert is bonded inside the shell. The insert is of tungsten carbide or ceramic for resisting erosion. The insert has an extended portion that extends below the rim of the outer member for protecting the retaining ring from flowing drilling fluid.

3 Claims, 4 Drawing Figures

CLAD MUD NOZZLE

BACKGROUND OF THE INVENTION

1. Field of the Invention:

This invention relates in general to earth boring drill bits, and in particular to an improved drill bit nozzle for discharging drilling fluid against the bottom of the bore hole.

2. Description of the Prior Art:

The most common type of bit for drilling oil and gas wells has three rotatable and generally conical cutters. The cutters have teeth that disintegrate the earth's formations during drilling. Fluid is pumped down from the string and discharged from three outlets in the bit. The fluid cools the bit and circulates cuttings up the borehole to the surface of the earth.

One type of drilling fluid is a liquid slurry known as "mud" that often contains particulates such as abrasive sand particles. Nozzles formed of sintered tungsten carbide are mounted in the fluid outlets of the bit to reduce erosion. Each nozzle is a short cylinder with a converging axial bore. It is retained within the bore by a snap or retaining ring received within a groove formed in the drilling fluid passage.

While this type of nozzle is in widespread use, the high velocity discharge of mud and resulting turbulence around the bit tends to erode the steel retaining ring, particularly when the mud contains a large amount of abrasive material. Erosion also occurs when the bit is in the hole a relatively long time, when the bit is drilling in a soft formation, and when an exceptionally high nozzle velocity is used. If the retaining ring breaks or loosens, the nozzle is rapidly expelled from the passage. The passage outlet quickly erodes, and the cutting teeth will be damaged by contact with the nozzle in the borehole.

When exceptional erosion conditions exist, a shrouded nozzle has been used in the prior art. One known shrouded nozzle has an annular groove for receiving the snap ring. The portion of the nozzle downstream of this annular groove serves as a flange to protect the snap ring from turbulently flowing fluid around the exterior of the bit. A segment of this circular flange is removed to provide access to the retaining ring ends for installation.

While this shrouded nozzle is successful, there is a tendency for cracks to occur at the sharp corners within the groove. These cracks occur because the shroud is comprised entirely of tungsten carbide and formed by a pressing technique which induces such cracks. Another disadvantage of tungsten carbide drill bit nozzles in general is the expense of the material.

SUMMARY OF THE INVENTION

It is accordingly a general object of this invention to provide an improved mud nozzle for an earth boring drill bit.

It is a further object of this invention to provide an improved drill bit nozzle that provides protection to its retaining ring, yet avoids sharp corners that tend to create cracks during pressing.

It is a further object of this invention to provide an improved drill bit nozzle that is more economical to produce than the prior art nozzles, and yet one that has excellent resistance to corrosion.

In accordance with these objects, a nozzle is provided that is constructed of two parts. The outer part is a shell secured within the bit passage by the retaining ring. The shell has a bore for receiving an insert or inner member. The insert has a converging bore for the passage of drilling fluid. Of the two parts, only the insert is constructed from tungsten carbide. The insert is bonded to the shell by an adhesive and has a cylindrical extended portion that extends past the shell to protect the retaining ring.

DESCRIPTION OF THE PREFERRED EMBODIMENT

Figure 1:
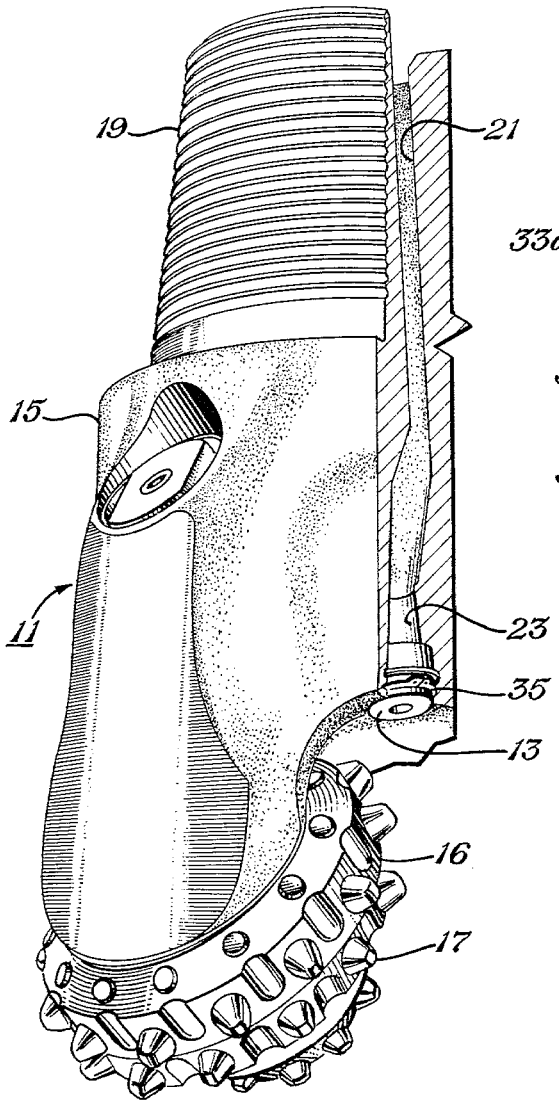
FIG. 1 is a fragmentary perspective view of a portion of a drill bit, partially sectioned to show a nozzle constructed in accordance with this invention.

FIG. 1 discloses a conventional drill bit 11 having a nozzle 13 constructed in accordance with this invention. Drill bit 11 has a body 15 composed of three head sections welded together during assembly. A rotatable cutter 16 is mounted to a depending pin (not shown) of each head section. Each cutter 16 has earth disintegrating teeth 17 comprised of tungsten carbide inserts interferingly secured in mating holes. Also, the teeth 17 may be milled into the steel shell of the cutter 16. Drill bit 11 has a set of external threads 19 on its upper end for securing to the lower end of the drill pipe (not shown). Drill bit 11 has an axial passage 21 for receiving drilling fluid that is pumped down the drill pipe.

Figure 2:
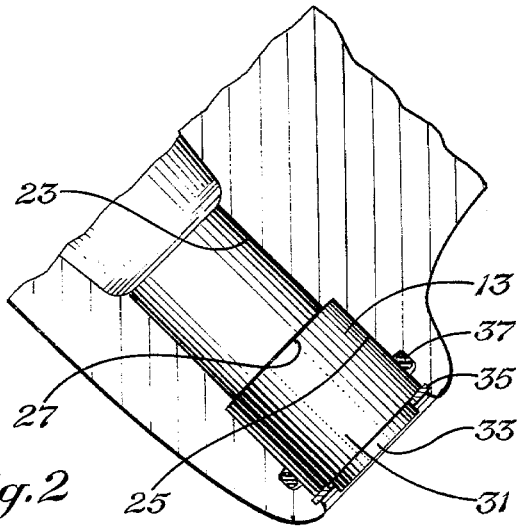
FIG. 2 is a partial sectional view of a portion of the drill bit of FIG. 1, enlarged to show one of the nozzles in a receiving passage and the preferred retention and sealing means.

Referring also to FIG. 2, passage 21 separates into three passage portions or outlets 23 (only one shown) spaced 120° degrees apart. Each outlet 23 is located on a side of the bit between two cutters 16, and oriented generally downward for discharging fluid against the borehole bottom. Referring to FIG. 2, each outlet 23 includes an enlarged portion 25 that is cylindrical and of a greater diameter than the portion of outlet 23 that is immediately upstream from it. Enlarged portion 25 forms the extremity of the outlet 23 and defines a downwardly facing shoulder 27 A nozzles 13 is tightly received in each enlarged portion 25.

Figure 3:
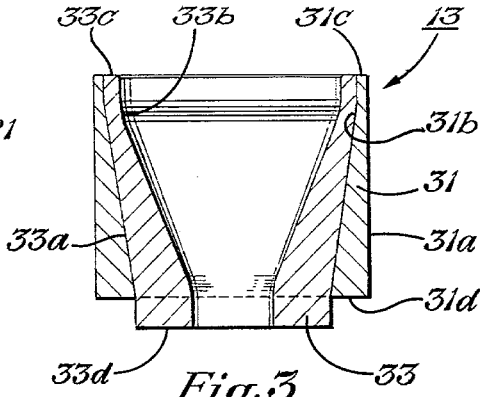
FIG. 3 is a vertical sectional view of one of the nozzles of the drill bit of FIG. 1.
Figure 4:
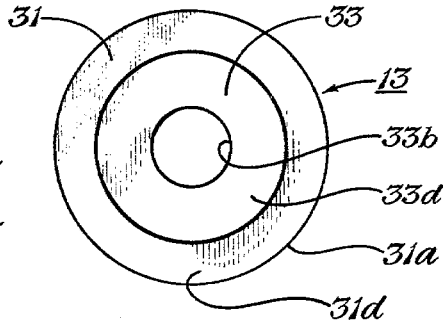
FIG. 4 is a bottom view of one of the nozzles of the drill bit of FIG. 1.

Referring to FIG. 3, nozzle 13 includes an outer part or nozzle shell 31. Shell 31 has a cylindrical outer surface 31*a* that is substantially the diameter of the enlarged portion 25 for close reception. Shell 31 has an axial bore 31*b* that has a cylindrical portion at its circular upper rim 31*c*. The remaining lower portion of bore 31*b* tapers or converges gradually to the circular lower rim 31*d*. The diameter of bore 31*b* is greater at the upper rim 31*c* than at the lower rim 31*d*. Rims 31*c* and 31*d* are located in parallel planes that are perpendicular to the axis of bore 31*b*.

An inner part of insert 33 is mounted inside the shell 31. Insert 33 has an outer surface 33*a* that is frustoconical for close mating reception inside bore 31*b* of the shell 31. Insert 33 has an axial bore 33*b* that is conical and converging, with a larger diameter at its circular upper rim 33*c* than at its circular lower rim 33*d*. In the embodiment shown, the diameter of bore 33*b* at upper rim 33*c* is the same as the diameter of outlet 23 immediately upstream of shoulder 27. If desired, the diameter of bore 33*b* at upper rim 33*c* may be slightly less than the diameter of outlet 23 immediately upstream of shoulder 27, but it should not be greater. A portion of bore 33*b* at each end is cylindrical, with the converging portion being intermediate. The insert's upper rim 33*c* is flush with the shell's upper rim 31*c*. The length of the insert 33 is selected so that the insert's lower rim 33*d* protrudes past the shell's lower rim 31*d* about ¼ inch. This difference in length defines a cylindrical extended portion that extends past the shell 31. The insert's outer surface 33*a* is bonded to bore 31*b* of the shell 31. The insert's lower rim 33*d* lies in a plane that is parallel with the plane of the upper rim 31*c* and 33*c* and flush with the extremity of outlet 23.

Referring to FIG. 2, the length of shell 31 is selected so that its upper rim 31*c* will be substantially contacting shoulder 27 while a retaining ring 35 contacts the lower rim 31*d*. There is some play of the nozzle 13 between shoulder 27 and ring 35 for tolerances. Retaining ring 35 is received in a mating annular groove formed in the enlarged end 25 of the passage outlet 23. Retaining ring 35 is a conventional snap ring of the type that is split and has two small holes (not shown) in its ends for receiving a snap ring pliers for varying the diameter. The outer diameter of the retaining ring 35 is slightly larger than its mating groove, so that its natural bias will urge it into the groove. The groove for the retaining ring 35 is positioned about ¼ inch from the extreme end of outlet 23. An O-ring 37 is located in a mating groove in the enlarged portion 25, between shoulder 27 and the groove for retaining ring 35.

In the construction of nozzle 13, sintered tungsten carbide is used to form the insert 33 in the same manner that prior art sintered tungsten carbide nozzles are formed. Basically, in this technique the insert is pressed into shape and retained by a binder while placed in a furnace for sintering the material into a composite shape. The outer member 31 is preferably mild steel with maximums of 0.28% carbon and 1.00% manganese. The adhesive used to bond the inner and outer members together is preferably an epoxy that utilizes an adhesive and activator. One suitable type is known as Armstrong Adhesive "Al" and Armstrong Activator "C". After coating with the adhesive, the assembled nozzle is held at a temperature of 175° F. to 200° F. for 1¼ hours. Then the assembled nozzle 13 is inserted into the outlet enlarged portion 25 until both upper rims 31*c* and 33*c* contact shoulder 27. O-ring 37 should be previously in place. Then, retaining ring 35 is inserted into its mating groove to retain nozzle 13.

In operation, bit 11 is screwed to the lower end of a string of drill pipe and lowered into the well. The drill pipe is rotated clockwise, this movement causing rotation of each cutter 16 about its own axis. Drilling mud is pumped down the drill pipe, through passage 21, into outlet 23 and out the insert bore 33*b*. The extended portion of the insert 33 creates an annular dead space around retaining ring 35, reducing the tendency to erode.

It should be apparent that an invention having significant advantages has been provided. The nozzle, by having a steel shell, utilizes less tungsten carbide. Also, the insert, being longer than the shell, provides an extended portion for protecting the retaining ring. The sharp corner between the extended portion and the circular rim of the shell does not have pressing cracks since the nozzle is not an integral composite part, rather is of two separate materials. The steel shell is not exposed to the flowing drilling fluid, thus does not need the barasion resistance required by the insert.

While the invention has been shown in only one of its forms, it should be apparent to those skilled in the art that it is not so limited, but is susceptible to various changes and modifications thereof. For example, the insert may be formed of ceramic.

I claim:

1. In an earth boring drill bit of the type having a plurality of rotatable cutters mounted on a body, the body having an integral passage with at least one oulet for the passage of drilling fluid, the passage having an enlarged diameter portion at its outlet that is separated from the passage immediately upstream by a downwardly facing shoulder, an improved nozzle comprising in combination;

a nozzle shell positioned in the enlarged portion, the shell having a circular upper rim in contact with the shoulder, a bore and a circular lower rim;

a nozzle insert bonded to the bore of the shell, the insert having a bore for receiving and discharging drilling fluid from the passage, the insert having a circular upper rim flush with the upper rim of the shell and an extended portion extending past the lower rim of the shell; the insert being formed of a material selected from the group consisting of tungsten carbide and ceramic; and retaining means in contact with the lower rim of the shell and the passage for releasably securing the nozzle in the passage.

2. In an earth boring drill bit of the type having a plurality of rotatable cutters on a body, the body having an internal passage with at least one outlet for the passage of drilling fluid, the passage having an enlarged diameter portion at its outlet that is separated from the passage immediately upstream by a downwardly facing shoulder, an improved nozzle comprising in combination:

a nozzle shell having a cylindrical outer wall surface closely received within the enlarged portion, the shell having a circular upper rim in contact with the shoulder, a bore and a circular lower rim, the bore being tapered with a smaller diameter at its lower end that at its upper end;

a nozzle insert having an outer wall surface bonded to the bore of the shell, and an extended portion that extends past the rim of the shell, the insert having a circular upper rim flush with the upper rim of the shell and a converging bore for receiving and discharging drilling fluid from the passage, the insert being formed of a material selected from the group consisting of tungsten carbide and ceramic; and a retaining ring extending around the extended portion of the insert, and received within a mating groove in the passage in contact with the shell's lower rim to retain the nozzle.

3. In an earth boring drill bit of the type having a plurality of rotatable cutters mounted on a body, the body having an internal passage with at least one outlet for the passage of drilling fluid, the passage having an enlarged diameter portion at its outlet that is separated from the passage immediately upstream by a downwardly facing shoulder, an improved nozzle comprising in combination:

a nozzle shell having a cylindrical outer wall surface closely received within the enlarged portion, the shell having a circular upper rim in contact with the shoulder and having a circular lower rim, the shell having an axial bore that is tapered with a smaller diameter at its lower rim than at its upper rim;

a nozzle insert of sintered tungsten carbide having an outer wall surface with a tapered portion bonded by adhesive to the bore of the shell, and having a cylindrical extended portion that protrudes past the lower rim of the shell and is of lesser diameter than the shell's lower rim, the insert having a circular upper rim in contact with the shoulder, and a converging axial bore, the diameter of the insert's bore at its upper rim being the same as the diameter of the passage immediately upstream of the shoulder; and a retaining ring extending around the extended portion of the insert, received within a mating groove in the passage, and in contact with the shell's lower rim to retain the nozzle.

* * * * *